US005996362A

United States Patent [19]

Likitcheva

[11] Patent Number: 5,996,362

[45] Date of Patent: Dec. 7, 1999

[54] WATER HEATER MODIFIED FROM REFRIGERATED MACHINE USING TWO REFRIGERANT PATHS AND TWO DIFFERENT TYPES OF CONDENSERS WORKING ALTERNATIVELY

[76] Inventor: Pichit Likitcheva, 28/1 Soi Chuasuwan Udomsuk Praves, Bangkok 10260, Thailand

[21] Appl. No.: 09/154,392

[22] Filed: Sep. 16, 1998

[30] Foreign Application Priority Data

Jul. 17, 1998 [TH] Thailand ..... 044990

[51] Int. Cl.[6] ..... F25B 41/00

[52] U.S. Cl. ..... 62/174; 62/196.4; 62/197; 62/509

[58] Field of Search ..... 62/238.1, 238.6, 62/238.7, 196.4, 196.3, 509, 197, 199, 200, 174

[56] References Cited

U.S. PATENT DOCUMENTS 1,874,803 8/1932 Reed ..... 62/238.1
3,357,199 12/1967 Harnish ..... 62/181
4,457,137 7/1984 Kohzuma ..... 62/158
4,592,206 6/1986 Yamazaki et al. ..... 62/160
4,693,089 9/1987 Bourne et al. ..... 62/79
4,955,207 9/1990 Mink ..... 62/238.6
5,465,591 11/1995 Cur et al. ..... 62/439
5,709,097 1/1998 Kim et al. ..... 62/206

*Primary Examiner*—Henry Bennett
*Assistant Examiner*—Marc Norman
*Attorney, Agent, or Firm*—Ladas & Parry

[57] ABSTRACT

The water heater modified from refrigeration machine or air condition is constructed by adding an apparatus for heat accumulation by means of water parallel to the condenser of the original system, this modified system can be controlled to work as an ordinary refrigeration machine or air conditioner, or to work simultaneously both as a refrigeration machine or air conditioner and also as a water heater, the advantages of this water heater are that it is obtained by a simple modification to the existing refrigeration machine or air conditioner, it can be installed at a remote distance convenienty without decreasing the effectiveness and the safety of the original system, and it can be operated to supply hot water without any additional energy consumption from what being consumed for supplying cold air by an original refrigeration machine or air conditioner itself.

20 Claims, 3 Drawing Sheets

WATER HEATER MODIFIED FROM REFRIGERATED MACHINE USING TWO REFRIGERANT PATHS AND TWO DIFFERENT TYPES OF CONDENSERS WORKING ALTERNATIVELY

FIELD OF THE INVENTION

The present invention relates to a water heater modified from refrigeration machine and more particularly to a water heater modified from refrigeration machine using two refrigerant paths and two different types of condensers working alternately.

BACKGROUND OF THE INVENTION

In general, refrigeration machine or air conditioner is built by using only one refrigerant path starting from a compressor which compresses refrigerant through its discharge port to a single condenser that condenses the refrigerant until it becomes liquid and is sent to an evaporator at which its coolness is evaporated into the room that requires to be air conditioned. The refrigerant is then sent back to the compressor through the suction port and again the refrigerant is compressed until its pressure is high enough to flow through the discharge port and circulates through this single condenser path in the same manner as explained above repeatedly until the system is turned off. Such a system is the so called conventional system.

The condenser condenses the refrigerant either by an electric blower blowing away heat or by applying water flowing in the direction opposite to the direction of refrigerant to exchange heat directly as done inside an apparatus called heat accumulator from refrigeration machine. There has been several inventions, one by this inventor, which combined together the above two methods within the same apparatus modified from refrigeration machine or air conditioner. The main purpose of these inventions are to obtain hot water from heat accumulators for some useful purposes and to safe energy for heating up water.

By the inventions mentioned above, there have been the methods to increase the temperature of the water without using any heater that has consumed a huge amount of electrical power, fuel, gasoline or other sources of energy for a long time in the past. However, The apparatus and methods obtained in the prior arts are not quite convenience and effective for using in some applications.

SUMMARY OF THE INVENTION

It is an object of the present invention to modify a refrigeration machine or an air conditioner that has to consume an amount of energy to be able to supply cool air such that it can also supply hot water simultaneously by that same amount of energy without any additional energy consumption.

It is another object of the present invention to obtain a water heater by a least modification to the existing refrigeration machine or air conditioner and also without decreasing the effectiveness of the original system.

It is yet another object of the present invention to obtain a water heater modified from refrigeration machine or air conditioner that can be applied for variety of applications conveniently without any limitation on distance.

The objects mentioned above are achieved by adding an apparatus for heat accumulation by means of water into the original cooling system having a condenser that uses an electric blower to blow out heat to construct a modified system. The modified system comprises two types of condensers working alternately according to an instruction from the electrical control system which may instruct both of them to work as an ordinary refrigeration system or to work simultaneously both as a refrigeration system and also as a heater.

The construction of water heater modified from refrigeration machine is made to include one compressor to compress refrigerant through a discharge port and also is built to include two refrigerant paths. Path ① is a refrigerant path leading to the first condenser using an electric blower to blow out heat. Path ② is a refrigerant path leading to the second condenser working also as an apparatus for heat accumulation by means of water. Both paths are combined at an (evaporator and becomes a single refrigerant path leading to a compressor. The compressor compresses refrigerant to flow and circulates in this system everytime it is turned on.

To enhance the effectiveness of the water heater modified from refrigeration machine, the apparatus in this invention is designed such that it is convenient for installation and without any complicate engineering computation existing due to a large distance between the condenser, evaporator and the location where hot water has to be supplied. In addition, this invention is designed to include a safety device to protect the compressor from being damaged by a large amount of pressure viriation in the system as a main purpose, and to increase its efficiency by saving an amount of power consumption as a secondary purpose, both during the start-stop of the heating process that may happen oftenly in the system. This safety device is made by the installation of a feedback solenoid valve across the compressor between the sunction port and the discharge port to minimize the pressure difference of the compressor during the starting of the second condenser.

To obtain an equivelent condensing rate of the refrigerant passing through condensor in practice, the volume of the refrigerant needed for path ①, using the blower, greater than the refrigerant needed for path ②, using the water. This happens because the effectiveness of heat removal from the condenser by the blower on path ① is less than the effectiveness of heat removal from the condenser by the water on path ②. Whenever path ② is instructed to work by the control circuit, an excess amount of refrigerant occurs in path ② system. To solve this problem, the inventor of this invention has designed a refrigerant reservoir to store the excess amount of refrigerant inside path ② system. This reservoir together with receive valve and discharge valve are connected in series to form an auxiliary path for refrigerant departing from path ② and arriving at the evaporator. These two valves are the important components of the system that make this invention works perfectly.

DESCRIPTION OF THE PREFERRED EMBODIMENTS

Preferred embodiments of the present invention will be described below with reference to the accompanying drawings.

Figure 1:
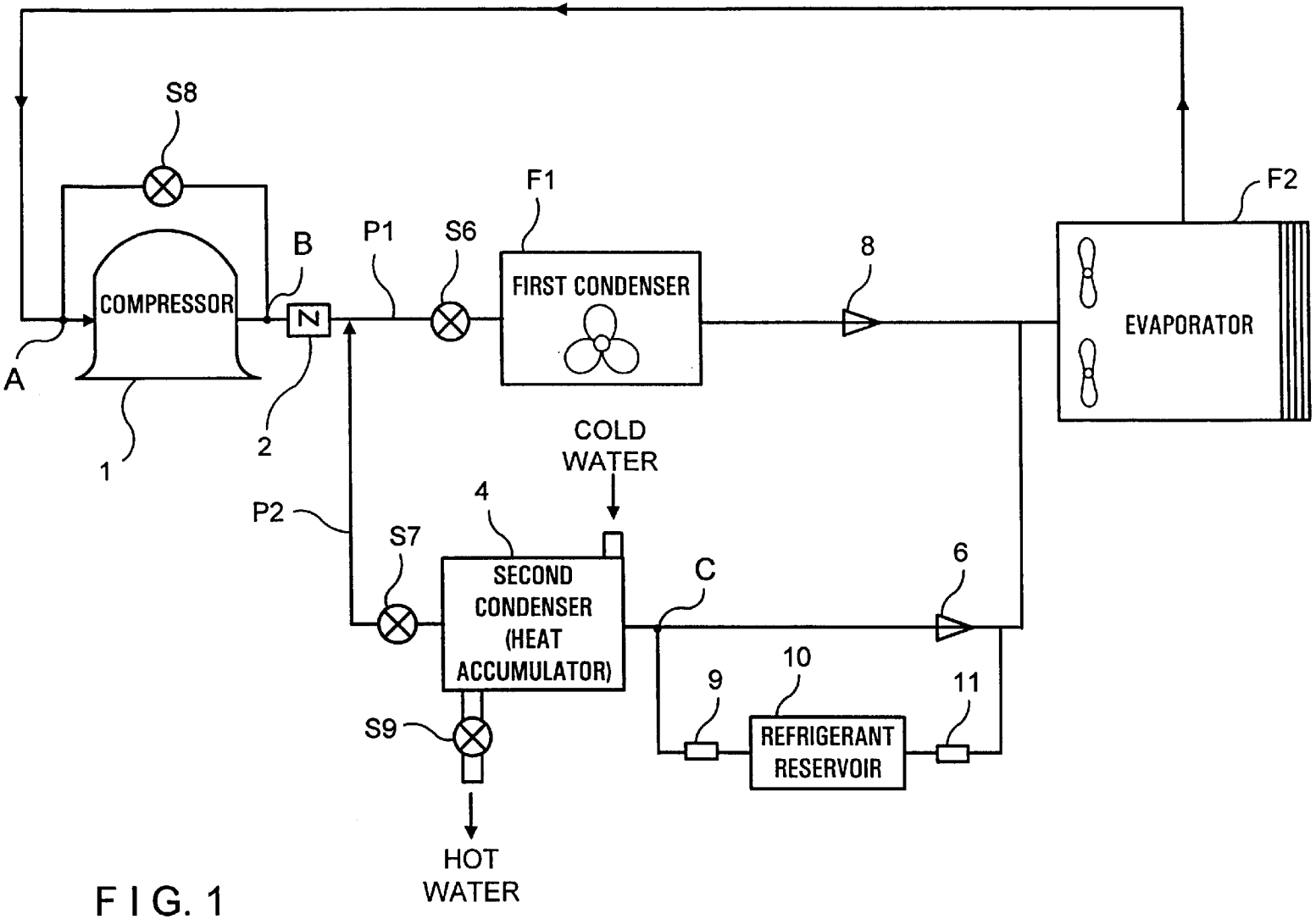
FIG. 1 illustrates a water heater modified from refrigeration machine using two refrigerant paths and two different types of condensers working alternately according to this invention.

In FIG. 1, an electrical controlled feedback solenoid valve (S8) is connected across the compressor (1) between sunction port A and discharge port B and the directional valve (2) is installed outside port B to protect the reversal of the refrigerant and also to adjust the difference of the pressure at the starting of the compressor (1). At the output of the directional valve (2), the refrigerant path is made into two paths. The first path ① includes a solenoid valve (S6) which is controlled by means of electrical device, a first condenser (F1) which uses a blower to blow away heat to condense refrigerant flowing inside refrigerant tube, and a pressure reducer (8) which is used to reduce refrigerant pressure before it is sent to the evaporator (F2). The second path ② includes a solenoid valve (S7) which is controlled by means of electrical device, a second condenser or a heat accumulator (4) which uses water flowing in opposite direction to move away heat to condense the refrigerant flowing inside refrigerant tube, and a pressure reducer (6) which is used to reduce refrigerant pressure before it is sent to the evaporator (F2). In addition, an auxiliary path including a receive valve (9), a refrigerant reservoir (10) and a discharge valve (11) is connected between the output of second condenser of path ② at point C and the input of the evaporator (F2).

Figure 2:
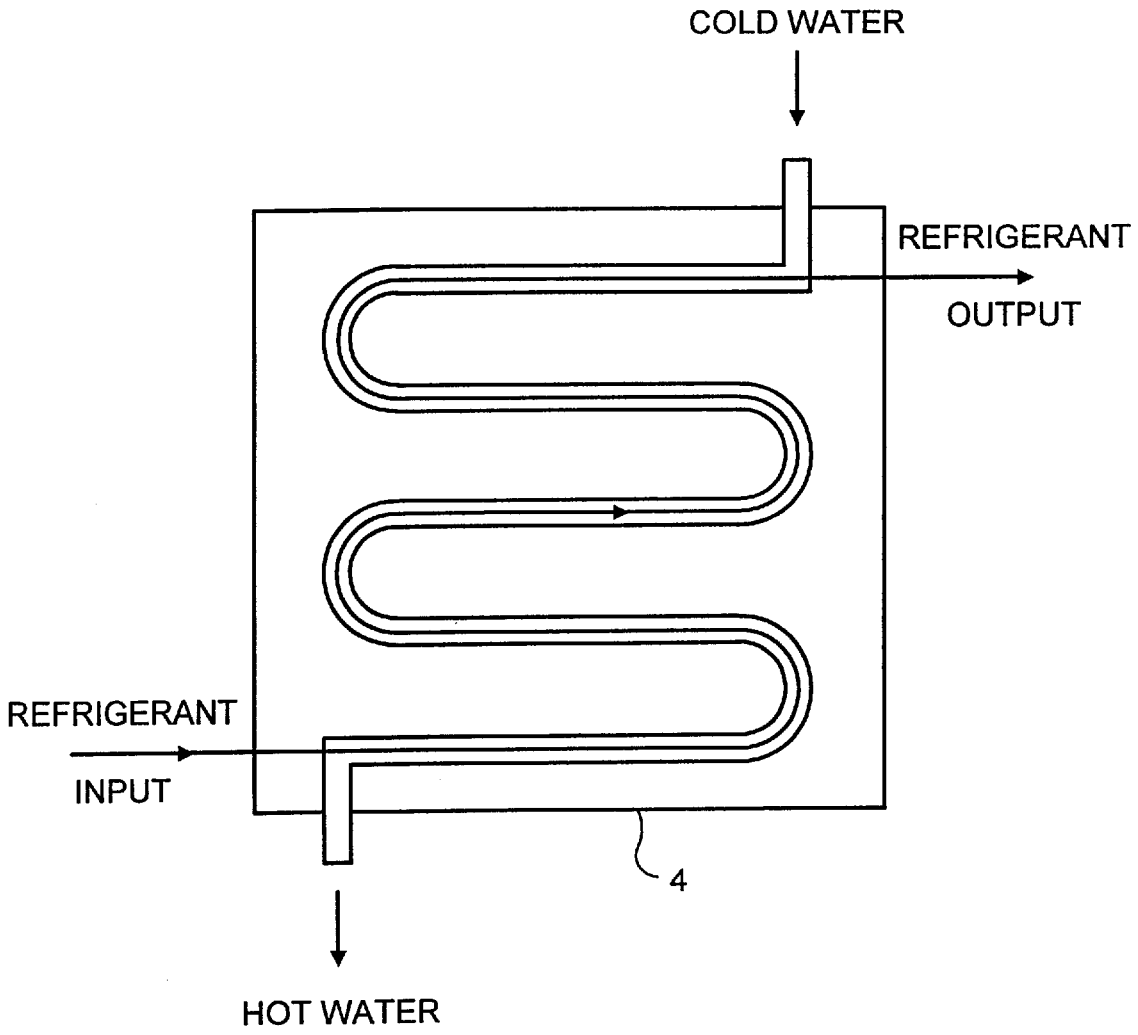
FIG. 2 illustrates an example of a heat accumulator which is applicable as a second condenser for this invention.

As the refrigeration system is instructed to produced hot water in addition to producing cooling air, the electrical system will instruct solenoid valve S7 of path ② and S9 of the heat accumulator (4) to open simultaneously while solenoid valve S6 of path ① is instructed to close and the condenser F1 is instructed to stop its electric blower. The refrigerant will change its path to flow along path ② and transfer heat to the water flowing in opposite direction inside the heat accumulator (4) and then flows through the pressure reducer (6) and the evaporator (F2) back to the compressor ①. An example for the design of the heat accumulator (4) is shown in FIG. 2.

Figure 3:
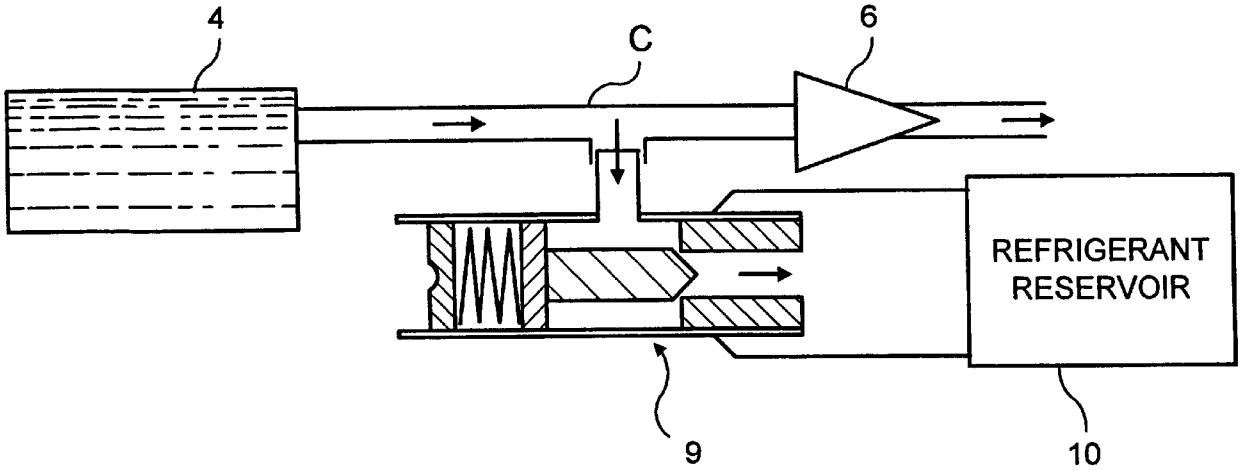
FIG. 3 illustrates the structure of a receive valve (9, in FIG. 1) according to this invention.

At position C on path ②, the excess refrigerant flows through receive valve (9) as shown in FIG. 3 and is stored inside the refrigerant reservoir (10). The receive valve (9) is open to receive the excess refrigerant by a spring mechanism which is controlled by a predetermined pressure. When the refrigerant flowing from heat accumucator (4) reaches receive valve (9) with a pressure greater than the predetermined pressure, its spring will be pushed backward together with the valve needle and causes an auxiliary path to open for the excess refrigerant to flow into the refrigerant reservoir (10).

Figure 4:
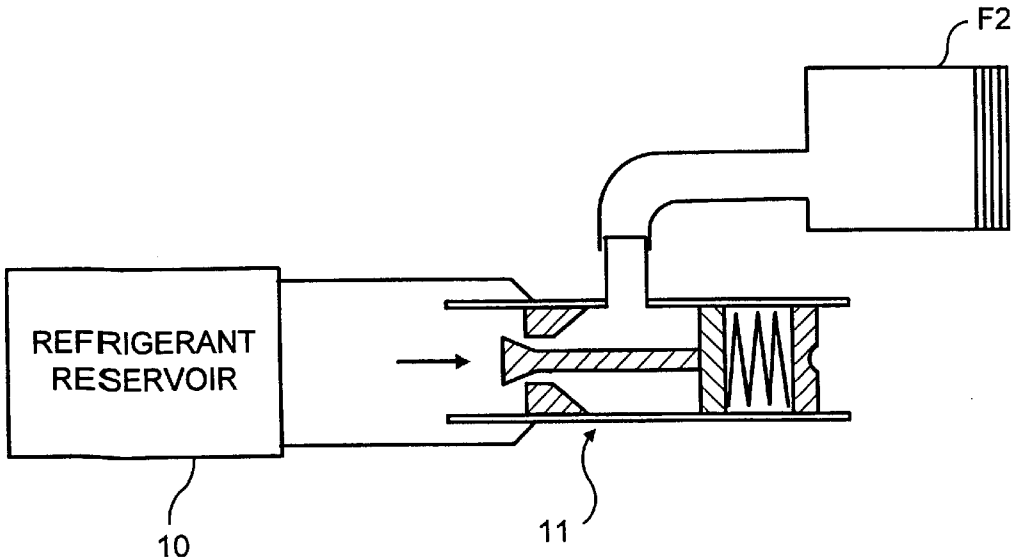
FIG. 4 illustrates the structure of a discharge valve (11, in FIG. 1) according to this invention.

In the situation where an evaporator has less refrigerant, the pressure of the refrigerant will be decreased at the discharge valve (11). The predetermined pressure of the spring of the output valve (11), as shown in FIG. 4, will be greater than the refrigerant pressure and the valve needle will be pushed forward and causes the auxiliary path to open for the excess refrigerant stored inside the refrigerant reservoir to flow into the evaporator (F2).

At the output of an evaporator (F2), all refrigerant paths are combined to be a single path for the refrigerant to flow into the compressor (1). The compressor as usual compresses and discharges the refrigerant to circulate in the system repeatedly.

When the system is instructed to stop supplying hot water, the electrical controlled device will instruct solenoid valve S7 and solenoid valve S9 to close, and at the same time instruct solenoid valve S6 to open and condenser F1 to start their operation. Then the refrigerant changes its path from path ② to be path ① and flows through solenoid valve S6, first condenser (F1), pressure reducer (8), evaporator (F2) and back to the compressor (1). As a result, the system will work as an ordinary refrigeration machine until a new instruction is made.

This system can be easily controlled to work alternately as a water heater and also as a refrigeration machine simultaneously or as an ordinary refrigerant machine alone. The superiority of this system is that it can work alternately, safely and also efficiently by the help of an auxiliary path of path ② which includes receive valve (9), refrigerant reservoir (10) and discharge valve (11).

Many different embodiments of the present invention may be constructed without departing from the spirit and scope of the present invention. It should be understood that the present invention is not limited to the specific embodiment described in this specification. The following claims are to be accorded the broadest interpretation, so as to encompass all such modification and equivalent structures and functions.

I claim:

1. In a refrigeration or air conditioning apparatus having a first refrigerant path including a first condenser for the refrigeration or air conditioning and a pressure reducer in series, the improvements for heating a fluid, comprising:

a second refrigerant path in parallel with the first refrigerant path, the second refrigerant path including a second condenser for the heating of the fluid and a second pressure reducer in series;

control means for operating the first and second refrigeration paths alternately or simultaneously; and an auxiliary refrigerant path in parallel with the first or second pressure reducer for receiving, storing and discharging any excess refrigerant.

2. The refrigeration or air conditioning apparatus according to claim 1, wherein the control means includes a first valve in the first refrigerant path in advance of the first condenser and a second valve in the second refrigeration in advance of the second condenser.

3. The refrigeration or air conditioning apparatus according to claim 1, wherein the auxiliary refrigerant path includes an inlet valve, a refrigerant reservoir and an outlet valve in series.

4. The refrigeration or air conditioning apparatus according to claim 2, wherein the auxiliary refrigerant path includes an inlet valve, a refrigerant reservoir and an outlet valve in series.

5. The refrigeration or air conditioning apparatus according to claim 1, wherein the refrigeration or air conditioning apparatus further includes a compressor for the refrigerant, and further comprising a safety device for protecting the compressor from pressure variations.

6. The refrigeration or air conditioning apparatus according to claim 2, wherein the refrigeration or air conditioning apparatus further includes a compressor for the refrigerant, and further comprising a safety device for protecting the compressor from pressure variations.

7. The refrigeration or air conditioning apparatus according to claim 3, wherein the refrigeration or air conditioning apparatus further includes a compressor for the refrigerant, and further comprising a safety device for protecting the compressor from pressure variations.

8. The refrigeration or air conditioning apparatus according to claim 4, wherein the refrigeration or air conditioning apparatus further includes a compressor for the refrigerant, and further comprising a safety device for protecting the compressor from pressure variations.

9. The refrigeration or air conditioning apparatus according to claim 5, wherein the compressor has a suction port and a discharge port, and wherein the safety device includes a feedback solenoid valve across the compressor between the suction ard discharge ports and a directional valve between the discharge port and the first and second refrigerant paths.

10. The refrigeration or air conditioning apparatus according to claim 6, wherein the compressor has a suction port and a discharge port, and wherein the safety device includes a feedback solenoid valve across the compressor between the suction and discharge ports and a directional valve between the discharge port and the first and second refrigerant paths.

11. The refrigeration or air conditioning apparatus according to claim 7, wherein the compressor has a suction port and a discharge port, and wherein the safety device includes a feedback solenoid valve across the compressor between the suction and discharge ports and a directional valve between the discharge port and the first and second refrigerant paths.

12. The refrigeration or air conditioning apparatus according to claim 8, wherein the compressor has a suction port and a discharge port, and wherein the safety device includes a feedback solenoid valve across the compressor between the suction and discharge ports and a directional valve between the discharge port and the first and second refrigerant paths.

13. The refrigeration or air conditioning apparatus according to claim 1, wherein the fluid is water.

14. The refrigeration or air conditioning apparatus according to claim 2, wherein the fluid is water.

15. The refrigeration or air conditioning apparatus according to claim 4, wherein the fluid is water.

16. The refrigeration or air conditioning apparatus according to claim 8, wherein the fluid is water.

17. The refrigeration or air conditioning apparatus according to claim 12, wherein the fluid is water.

18. A modified refrigeration or air conditioning apparatus capable of working only as a refrigerator or an air conditioner and of working both as a refrigerator or an air conditioner and also as a fluid heater simultaneously, which is modified from a refrigerator or an air conditioner by adding a) a second refrigerant path including a second condenser which is capable of working as a refrigerant condensing apparatus and also as a fluid heating apparatus simultaneously and a second pressure reducer connected respectively in series, such that it is in parallel to the first refrigerant path including the first condenser which is capable of working only as refrigerant condensing apparatus and a first pressure reducer that has been connected respectively in a series between the compressor and the evaporator of the original refrigerant machine or air conditioner.

b) a control mechanism which is capable of controlling the first refrigerant path and the second refrigerant path and the second refrigerant path to be operational alternately and also synchronously in which said control mechanism includes a first solenoid valve which is installed in advance of said first condenser of said first refrigerant path, a second solenoid valve which is installed in advance of said second condenser of said second refrigerant path, and an electrically controlled device which is capable of opening the first solenoid valve and turning on said first condenser at the same time to allow refrigerant to flow through said first refrigerant path while synchronously closing the second solenoid valve and turning off said second condenser at the same time to stop refrigerant from flowing through said second refrigerant path, and vice versa; and c) an auxiliary path including an inlet valve, a refrigerant reservoir and a discharge valve connected in series, which is connected across said first pressure reducer of said first refrigerant path or across said second pressure reducer of said second refrigerant path, to receive and to store any excess amount of refrigerant occurring in said first path or said second path upon the switching of said two refrigerant paths from one to another, and to discharge this excess amount of refrigerant back into the system through an evaporator upon the switching back of said two refrigerant paths.

19. A modified refrigeration or air conditioning apparatus according to claim 1, in which a safety device including a feedback solenoid valve and a directional valve is used to protect the compressor from being damaged by any large pressure variation in the system occurring during the start-stop of the heating process, the safety device being provided by the installation of a feedback solenoid valve across the compressor between its suction port and its discharge port to minimize the pressure variation at the discharge port, together with an installation of a directional valve between the compressor and the junction of said first refrigerant path and said second refrigerant path to protect the reversal of the refrigerant from said two refrigerant paths back into the compressor.

20. A fluid heater modified from a refrigeration machine or air conditioner according to claim 18, in which said second condenser is arranged to be used with the type of fluid needed to be heated.

* * * * *